United States Patent [19]

Young

[11] Patent Number: 4,630,017

[45] Date of Patent: Dec. 16, 1986

[54] MAGNETIC STRUCTURE FOR CALIBRATING A CIRCUIT BREAKER

[75] Inventor: John W. Young, Lilburn, Ga.

[73] Assignee: Siemens Energy & Automation, Inc., Atlanta, Ga.

[21] Appl. No.: 656,230

[22] Filed: Oct. 1, 1984

[51] Int. Cl.[4] ..... H01H 77/06

[52] U.S. Cl. ..... 335/42; 335/176

[58] Field of Search ..... 335/16, 35, 38, 42, 335/174, 195, 176

[56] References Cited

U.S. PATENT DOCUMENTS

| | | | |
|---|---|---|---|
| 3,004,546 | 10/1961 | Robins et al. | 335/281 X |
| 3,244,835 | 4/1966 | Locher | 335/35 X |
| 3,275,959 | 9/1966 | Locher | 335/35 |
| 3,343,109 | 9/1967 | Jencks et al. | 335/26 |
| 3,530,414 | 9/1970 | Wagner | 335/174 |
| 3,783,423 | 1/1974 | Mater | 335/174 |
| 3,815,059 | 6/1974 | Spoelman | 335/16 |
| 3,946,346 | 3/1976 | Oster et al. | 335/16 |
| 4,071,836 | 1/1978 | Cook et al. | 335/195 |
| 4,088,973 | 5/1978 | Kussy et al. | 335/6 |
| 4,267,539 | 5/1981 | Guinan | 335/42 |
| 4,346,357 | 8/1982 | Kussy et al. | 335/16 |
| 4,409,573 | 10/1983 | DiMarco et al. | 335/16 |

*Primary Examiner*—George Harris

*Attorney, Agent, or Firm*—F. W. Powers; J. L. James

[57] ABSTRACT

A magnetic structure is provided for calibrating a circuit breaker. The magnetic structure includes an E-shaped core which has an adjustable center post for varying the magnetic force between the core and armature by changing the gap between the center post and the armature. Variations in the field for a given current allow the tripping current for the circuit breaker to be precisely calibrated.

5 Claims, 6 Drawing Figures

MAGNETIC STRUCTURE FOR CALIBRATING A CIRCUIT BREAKER

CROSS REFERENCE TO RELATED APPLICATIONS

The subject matter described in this application is related to the material disclosed in co-filed patent application Ser. Nos. 656,236, "A Molded Case Circuit Breaker Having A Reinforced Housing"—B. DiMarco and C. W. Stanford, 656,233, "Multipole Molded Case Circuit Breaker with A Common Contact Operating Crossbar Member"—B. Dimarco and C. W. Stanford, and 656,150, "Circuit Breaker Contact Arm Assembly Having A Magnetic Carrier"—B. DiMarco and C. W. Stanford.

BACKGROUND OF THE INVENTION

This invention relates generally to molded case circuit breakers and, more particularly, to a magnetic structure for calibrating a circuit breaker for tripping at a precise value of current.

A circuit breaker is a very useful device for interrupting a circuit under various conditions. For example, there are circuit breakers which interrupt the circuit when current flow of a certain magnitude flows through the breaker for a given period of time. Units of this type employ a thermal unit which responds to current flow over a period of time so that when current of a certain magnitude flows through the circuit breaker for a given period of time, the thermal unit responds by tripping the breaker thereby interrupting the circuit. Calibration is typically done by means of an adjusting screw.

In other types of circuit breakers, only a magnetic structure is used for tripping the breaker in response to current of a specified magnitude. In these circuit breakers, a magnetic unit is employed to trip the breaker in response to an over current condition, that is, current which exceeds a preselected current magnitude which is related to the rating of the breaker.

These breakers have adjustable settings so that a range of tripping current levels is available. Each of these settings represent a predetermined level of current. These levels are determined by design and are verified and set by calibrating the breaker. The breakers are calibrated by adjusting the distance between the armature and the magnet, by adjusting the biasing force on the armature, or both. This is normally done at the low setting and the high setting. The intermediate settings should be at their predetermined levels once the low and high setting is set.

At high settings, which normally represent large gaps between the armature and the magnet, calibration is more responsive to varying the biasing force. At low settings, which normally represent small gaps between the armature and the magnet, calibration is more responsive to the size of the gap.

Adjusting the biasing force is normally accomplished by adjusting a spring force on the armature. Adjusting the gap between the armature and the magnet is normally accomplished by moving the armature toward or away from the magnet. Since both of these adjustments are being made on the armature, each has a counteracting effect on the other making adjustment difficult and time consuming.

Accordingly, it is an object of the present invention to provide a simple structure for calibrating the tripping current of a circuit breaker.

Another object of the present invention is to provide a simple magnetic structure for a circuit breaker which is easily calibrated.

Yet another object of the present invention is to provide a simple magnetic structure for calibrating a circuit breaker which is useful for both high and low adjustments of the circuit breaker.

SUMMARY OF THE INVENTION

Briefly stated, in accordance with one aspect of the invention, the foregoing objects are achieved by providing a magnetic structure which has a frame and a coil mounted on the frame for creating a magnetic field in response to current flow through the coil. An E-shaped core is formed which has a movable center post for varying the gap between the magnet and the armature in response to movement of the center pole.

In another aspect of the invention, a magnetic structure is provided for calibrating a circuit breaker of the type having a trip lever. The magnetic structure includes a yoke frame and a pivotally mounted armature movable between a first position at which the armature is free of contact with the trip lever and a second position at which the armature is in operable contact with the trip lever. A coil is mounted on the frame for creating a magnetic field for moving the armature from the first position to the second position in response to current flow of a preselected magnitude through the coil. An E-shaped core is formed which has an adjustable center post for precisely controlling the current magnitude at which the armature moves from the first position to the second position.

The magnetic structure is a compact arrangement for calibrating the circuit breaker. By adjusting the position of the center post of the E-shaped magnetic core, the strength of the magnetic field which attracts the armature is varied for a given current and the tripping current for the circuit breaker is precisely varied. By adjusting the biasing force on the armature spring, the tripping current can also be varied. These two adjustments, while related, are made on separate parts and can be more precisely controlled.

BRIEF DESCRIPTION OF THE DRAWINGS

While the specification concludes with claims particularly pointing out and distinctly claiming the subject matter which is regarded as the invention, it is believed that the invention would be better understood from the following description of the preferred embodiment taken in conjunction with the accompanying drawings in which:

DESCRIPTION OF A PREFERRED EMBODIMENT

Figure 1:
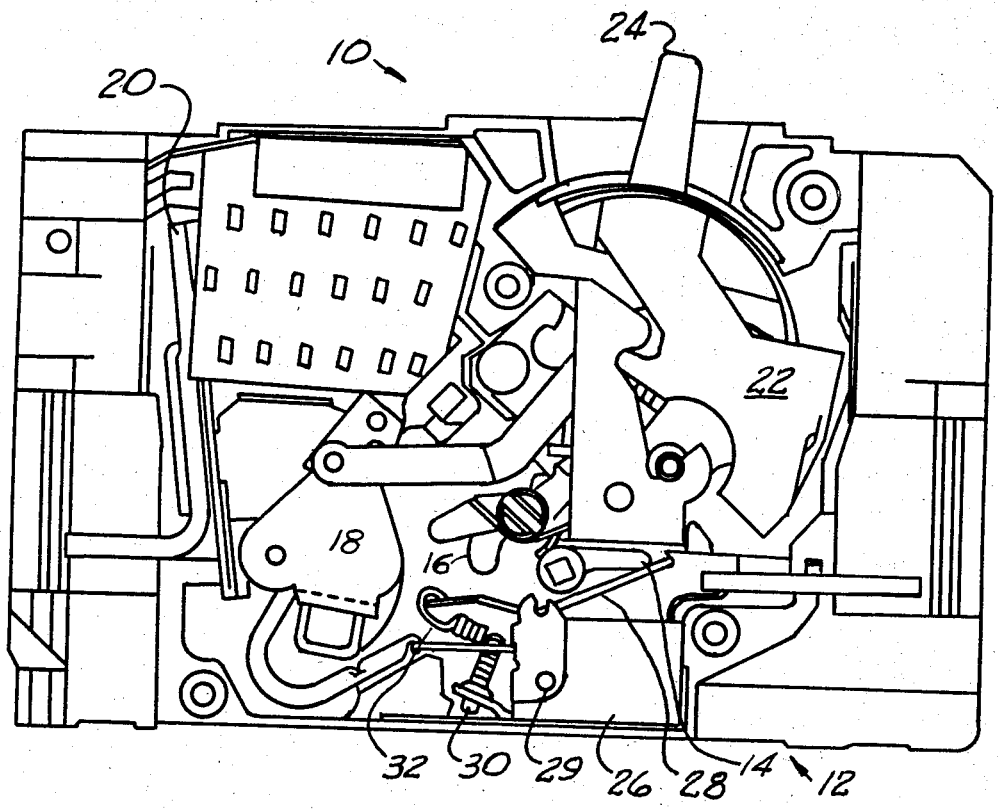
FIG. 1 is a view of a circuit breaker post base with the cover removed exposing the magnetic structure of the present invention.
Figure 3:
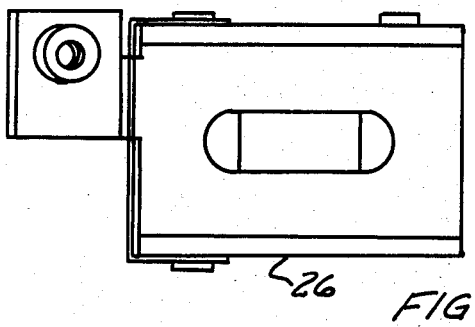
FIG. 3 is a top view of the magnetic structure of FIG. 2.
Figure 5:
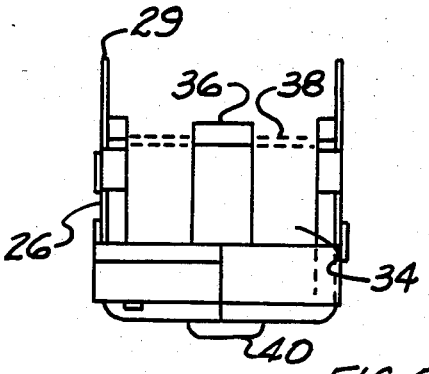
FIG. 5 is a left end view of the magnetic structure of FIG. 2.
Figure 2:
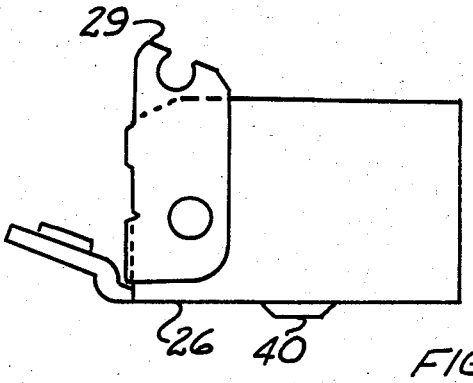
FIG. 2 is a simplified side view of the magnetic structure.

Referring to FIG. 1, a pole of a circuit breaker 10 is shown with the cover removed exposing the internal portions of the circuit breaker 10. The circuit breaker pole 10 includes a magnetic structure 12, an adjustment lever 14, a trip lever 16, a movable contact assembly 18, a stationary contact 20, and a handle assembly 22 which has a handle 24. The handle 24 is operable between an ON position and an OFF position. When the handle 24 is in the ON position, the movable contact assembly 18 and stationary contact 20 abut one another forming a path for current flow through the breaker. When the handle 24 is in the OFF position, the movable contact assembly 18 and the stationary contact 20 are spaced one from the other so that current does not flow through the breaker. As is known in the art, when the contacts 18, 20 are in the closed position, the breaker can be opened manually by operating handle 24 or by operating the trip lever 16.

The magnetic structure includes a frame 26, an armature 28, a non-magnetic bracket 29 attached to the frame 26 for pivotally mounting the armature 28 and an adjustment screw 30. As seen in FIG. 1, the adjustment screw 30 is threadably matable with a portion of the magnetic frame 26. The one end of the screw 30 is accessible through an opening in the housing of the circuit breaker 10. The other end of the adjustment screw 30 has a spring 32 attached thereto. The end of the coil spring 32 attached to the armature 28 biases the armature 28 away from the frame 26 and away from the trip lever 16. The other end of the armature 28 abuts the adjustment lever 14. In response to current flow which creates a magnetic field about the magnetic frame 26, the armature is attracted toward the frame. Since the armature 28 is pivotally mounted on the bracket 29 attached to the frame, movement of the one end of the armature 28 toward the frame causes the other end of the armature to move toward the trip lever 16 against the force of the spring 32. The amount of force that the spring exerts on the armature can be adjusted somewhat by the adjustment screw 30. The proximity of the armature to the magnetic frame can be adjusted somewhat by adjusting the position of the adjustment lever 14.

Thus, for example, the circuit breaker may have a rating of 100 amperes continuous current. The same breaker may then have an instantaneous rating which varies in a range from a low of about 300 amperes to a high of about 1000 amperes. The position of the adjustment lever is related to the instantaneous current rating desired and is controlled by turning a cam. Thus, the instantaneous setting is chosen in increments or steps between the low and high ratings.

Adjusting the adjustment lever 14 will move the armature toward and from the frame which translates into less current required to trip the breaker when the armature is near the frame than when the armature is further away from the frame. On the other hand, the adjustment screw 30 can be used to adjust the tension the spring 32 exerts on the armature since the armature, in moving toward the frame, works against the spring 32. When the attractive force of the armature overcomes the force of the spring, the spring end of the armature engages the trip lever 16 and the breaker trips open.

The two adjustments noted above do not directly change the strength of the magnetic field; instead, these adjustments alter the spacing of the armature from the magnetic frame. The adjustment screw 30 directly and deliberately changes the spring force on the armature.

Referring now to FIGS. 1–5, the magnetic structure includes the frame 26, a coil 34 and a member 36 which is mounted on the yoke frame 26 forming an E-shaped core. Preferably, the center pole or post 36 of the core is an adjustable pole for precisely controlling the current magnitude at which the armature 28 moves from the first position to the second position. As an alternative, the frame 26 could be adjustable while the center post remains fixed.

The coil 34 is preferably wound on a non-magnetic spool 38 to precise manufacturing tolerances as is known in the art. The spool 38 of wire and the center post 36 both are then mounted on the frame 26. As shown in the drawings, the center post 36 is preferably thicker than the outer poles of the magnetic structure 12. By this construction, it has been found that the center pole can be moved vertically as viewed in FIG. 5 by about 0.1 inches which varies the current by about 20% at the low setting of the breaker for instantaneous tripping.

While the operation of the present invention is believed to be apparent from the foregoing description, it should be emphasized that the low adjustments can first be made using the adjustment screw 40 and the high adjustment can then be fine tuned using screw 30 which will not appreciably affect the low setting.

Figure 6:
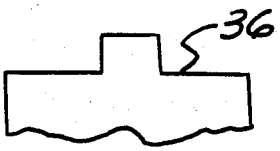
FIG. 6 illustrates the shape of the center post of the magnetic structure of FIG. 5.
Figure 4:
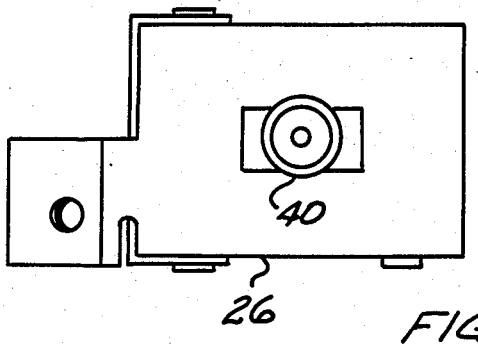
FIG. 4 is a bottom view of the magnetic structure of FIG. 2.

It is possible, and perhaps preferable, to shape the end of the center pole as shown in FIG. 6 to concentrate the flux to the center of the post 36. This will facilitate a change in the opening current over the range of adjustment of the screw 40 and center post 36. Thus, once the high adjustment has been made, the low calibrating adjustment is made by turning screw 40 to raise or lower the center post 36 to increase or decrease the magnetic field strength and the force attracting the armature.

Changing the relationship of the center pole 36 to the frame 26 does not alter the tension in the spring 32. The only variable is the magnetic field strength which varies with the position of the center post 36.

It will now be understood that there has been disclosed an improved system for calibrating a magnetic circuit breaker which is compact, simple and effective. As will be evident from the foregoing description, certain aspects of the invention are not limited to the particular details of the examples illustrated, and it is therefore contemplated that the other modifications or applications will occur to those skilled in the art. It is accordingly intended that the claims shall cover all such modifications and applications as do not depart from the true spirit and script of the invention.

What is claimed as new and desired to be secured by Letters Patent of the United States is:

1. A circuit breaker operable between an open position and a closed position comprising:

a housing;

a trip lever mounted on the housing and operable to open the circuit breaker;

a yoke frame mounted on the housing;

an armature pivotally mounted on one of the yoke frame and housing and movable between a first position at which the armature is free of contact with the trip lever and a second position at which the armature is in operable contact with the trip lever;

an adjustment screw;

a coil spring having one end connected to the armature and the other end connected to the adjustment screw, said spring biasing the armature away from the trip lever;

a coil mounted on the yoke frame for creating a magnetic field for moving the armature from the first position to the second position to trip the circuit breaker in response to current flow of a preselected magnitude through the coil; and an adjustable core for the coil for precisely controlling the current magnitude at which the armature operates the trip lever.

2. A circuit breaker, as set forth in claim 1, wherein the core and yoke frame form a general E configuration with the outer poles of the E and the center pole of the E being adjustable one relative to the other.

3. A circuit breaker, as set forth in claim 2, wherein the breaker tripping current varies over a range of about 20% as one of the center post and yoke coil is adjusted.

4. A circuit breaker, as set forth in claim 2, wherein one of the yoke coil and center post has a displacement of about 0.1 inches.

5. A circuit breaker, as set forth in claim 1, wherein the armature has a first end portion and a second end portion, said first and portion being biased away from the core by the coil spring, said first end portion moving toward the core against the force of the spring in response to current flow of a preselected magnitude through the coil.

* * * * *